US007380675B2

(12) United States Patent
Gubbey et al.

(10) Patent No.: US 7,380,675 B2
(45) Date of Patent: Jun. 3, 2008

(54) METHOD AND DEVICE FOR PROCESSING SHEET-LIKE ARTICLES

(75) Inventors: Herbert Gubbey, Ebersberg (DE); Rudolf Sperger, Pfeffenhausen (DE)

(73) Assignee: Giesecke & Devrient GmbH, Munich (DE)

( * ) Notice: Subject to any disclaimer, the term of this patent is extended or adjusted under 35 U.S.C. 154(b) by 564 days.

(21) Appl. No.: 10/297,933

(22) PCT Filed: Jun. 18, 2001

(86) PCT No.: PCT/EP01/06855

§ 371 (c)(1),
(2), (4) Date: Jul. 18, 2003

(87) PCT Pub. No.: WO01/99060

PCT Pub. Date: Dec. 27, 2001

(65) Prior Publication Data

US 2004/0007509 A1 Jan. 15, 2004

(30) Foreign Application Priority Data

Jun. 20, 2000 (DE) ..... 100 30 227

(51) Int. Cl.
*B07C 5/00* (2006.01)

(52) U.S. Cl. ..... 209/534; 209/900; 235/375

(58) Field of Classification Search ..... 209/534, 209/900, 847; 235/379
See application file for complete search history.

(56) References Cited

U.S. PATENT DOCUMENTS 4,025,420 A 5/1977 Horino
4,236,639 A * 12/1980 Boettge et al. ..... 209/534
4,437,571 A 3/1984 Ohmura
4,625,870 A * 12/1986 Nao et al. ..... 209/534
5,555,983 A * 9/1996 Yamagishi ..... 209/534
5,617,956 A * 4/1997 Werner et al. ..... 209/534
6,439,395 B1 * 8/2002 Voellmer et al. ..... 209/534
2002/0003163 A1 * 1/2002 Peebles et al. ..... 235/379

FOREIGN PATENT DOCUMENTS

| | | |
|---|---|---|
| DE | 24 46 280 C3 | 4/1975 |
| DE | 27 60 269 C2 | 1/1979 |
| DE | 31 40 680 C2 | 5/1982 |
| GB | 2 085 412 A | 4/1982 |
| WO | WO 99/27488 | 6/1999 |

* cited by examiner

*Primary Examiner*—Kaitlin S. Joerger
(74) *Attorney, Agent, or Firm*—Bacon & Thomas, PLLC

(57) ABSTRACT

The present invention relates to a method and apparatus for processing sheet material, in particular bank notes, papers of value and the like.

When sheet material is checked for adherence to criteria, at least a group of sheet material fulfilling the criteria and a group of sheet material not fulfilling the criteria are formed. The group of sheet material not fulfilling the criteria is divided into at least two subgroups. This makes it possible to treat the subgroups separately during reworking and pay special attention to the presence of certain problems or errors, e.g. forgeries. This altogether obtains a facilitation of reworking, thereby reducing the effort.

12 Claims, 2 Drawing Sheets

METHOD AND DEVICE FOR PROCESSING SHEET-LIKE ARTICLES

BACKGROUND

The present invention relates to a method and apparatus for processing sheet material, in particular bank notes, papers of value and the like.

DE 27 60 269 C2 discloses an apparatus for automatic sorting of thin sheet material having an input pocket for receiving bank notes, a singling device, a transport system, a checking device disposed along the transport system and at least one deposit device. In accordance with the results of the checking device, sheet material is divided into cases fit for circulation, cases unfit for circulation and indeterminable cases, the fit and unfit sheet material being transported to different deposit devices and the indeterminable cases stored in a buffer. Data on the deposited sheet material are stored in a data memory. These data are used for, among other things, preparing a protocol that permits a statement about the indeterminable cases. The protocol is used at a manual reworking station for evaluating and checking by hand the indeterminable cases taken from the buffer. The result of the manual check can be inputted to the data memory to complete the data.

The known apparatus thus has the advantage that the automatic sorting process can be continued when indeterminable cases occur, since the indeterminable cases are deposited in a buffer and can be evaluated and checked by means of the prepared protocol at a later time or else simultaneously with the automatic sorting process. The apparatus can therefore be operated at maximum throughput without interruption.

However, the known apparatus has the disadvantage that when indeterminable cases occur frequently, this necessitates elevated effort for manual reworking at the manual reworking station. Since the operator of the automatic sorting apparatus frequently also does the reworking of the indeterminable cases at the manual reworking station parallel to automatic sorting, this nevertheless results sooner or later in an influence on operation that reduces throughput. This problem is increased further by the fact that sheet material that cannot be processed by the apparatus because of faulty processes in the apparatus is frequently additionally transported into the buffer or a further buffer. Such faulty processes can arise e.g. through simultaneous removal of more than one sheet by the singling device, skewed transport of sheet material, etc. Altogether, this increases the rate of sheet material to be manually reworked and thus the effort required for the operator.

In addition, sheet material processing apparatuses have become known in which the sorting or counting process is always interrupted when sheet material is checked by the checking device but cannot be determined by the checking device, e.g. because there is only one output pocket. In these cases an operator must do a manual check of the sheet material. The result of the check can be inputted to the apparatus by the operator by means of an input device and the sorting or counting process continued.

However, it is disadvantageous here that the apparatus interrupts the sorting or counting process each time sheet material that cannot be determined is checked. This hinders rapid processing of large quantities of sheet material. Moreover, the check is difficult and elaborate for the operator since it is not readily apparent which problem or error has prevented the apparatus from determining the sheet material.

SUMMARY

It is the problem of the present invention to state an apparatus and method for processing sheet material, in particular bank notes, papers of value and the like, that lead to a reduction of effort or a facilitation of manual reworking.

The basic consideration here is that during the check of sheet material for adherence to criteria at least a group of sheet material fulfilling the criteria and a group of sheet material not fulfilling the criteria are formed, the group of sheet material not fulfilling the criteria being divided into at least two subgroups, the first subgroup containing sheet material that is unrecognizable and/or was recognized as faulty, and the second subgroup containing sheet material not fulfilling the predetermined criteria but recognized during the check. Division of the group of sheet material not fulfilling the criteria into at least two subgroups offers the possibility of treating the subgroups separately during reworking and paying special attention to the presence of certain problems or errors, e.g. forgeries. This altogether obtains a facilitation of reworking, which reduces the effort.

BRIEF DESCRIPTION OF DRAWINGS

The invention will be explained in more detail in the following with reference to figures, in which.

DESCRIPTION OF VARIOUS EMBODIMENTS

Figure 1:
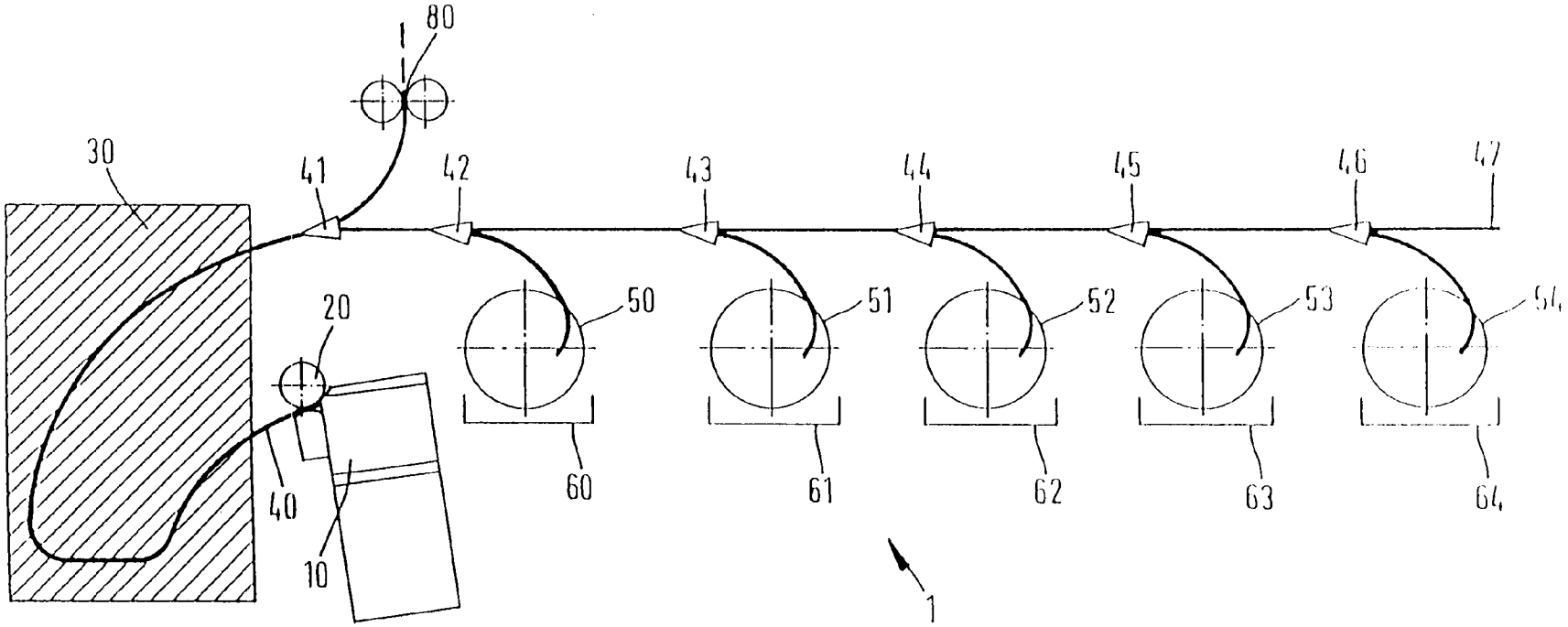
FIG. 1 shows a schematic representation of a first embodiment of an inventive apparatus for processing sheet material.

FIG. 1 shows a schematic representation of a first embodiment of inventive apparatus 1 for processing sheet material.

Apparatus 1 contains input pocket 10 for inputting a stack of sheets, singler 20 for singling the sheet material forming the stack of sheets in such a way that a single piece of sheet material is always inputted into transport system 40. Transport system 40 leads through checking device 30 where sheet material is checked. Checking device 30 is constructed in known fashion and contains for example optical, mechanical, magnetic and acoustic sensors that check the sheet material. If the sheet material to be checked is formed by bank notes, the check performed by the checking device can consist for example in checking the authenticity of the bank notes and their fitness with respect to soiling and wear. The signals of the different sensors are evaluated by the controller in checking device 30 and checked for adherence to predetermined criteria. The predetermined criteria can be for example threshold or limiting values that the sensor signals must be within to yield a valid check.

On the basis of the sheet material check performed by checking device 30, sheet material is supplied to different deposit devices 50, 60, 51, 61, 52, 62, 53, 63, 54, 64. For this purpose, diverters 42, 43, 44, 45, 46 located in transport system 40 are activated by checking device 30 in dependence on the check result. Further, diverter 41 is provided in transport system 40 for supplying sheet material to shredder 80 for destruction.

Checking device 30 contains a controller, which can be formed for example by a microprocessor, that performs both the evaluation of data delivered by the sensors and the control of the individual components of apparatus 1. Deviating from this, it can be provided that there is not only a controller in checking device 30 for evaluating the signals of the sensors but also a further controller for performing the control of the individual components of apparatus 1 in dependence on the results of checking device 30.

Extension 47 of transport system 40 indicates that the apparatus can have further deposit devices. It is likewise possible that fewer deposit devices are present than those shown.

Deposit devices 50 to 64 can be formed for example by known spiral slot stackers. The spiral slot stackers have rotating units 50, 51, 52, 53, 54 with pockets disposed in a spiral shape into which sheet material is introduced by transport system 40. A stripping device engaging the rotating unit is used to remove sheet material from the individual pockets and deposit and stack it in deposit devices 60, 61, 62, 63, 64.

When a stack of sheets is inserted into singling device 10, 20 consisting of input pocket 10 and singler 20, the individual pieces of sheet material contained in the stack are singled by singler 20 and supplied to transport system 40 in order to be checked in checking device 30.

If the sheet material consists for example of bank notes and the latter are to be sorted according to fitness, it can be provided that bank notes recognized as authentic and having very good fitness are placed in deposit device 52, 62. Bank notes recognized as authentic and having good fitness are placed in deposit device 53, 63. Bank notes recognized as authentic but having poor fitness are for example supplied by the transport system via diverter 41 to shredder 80 or alternatively placed in deposit device 54, 64. During processing of the bank notes the controller contained in checking device 30, or the separate controller, detects how many bank notes have been classified as very good, good or poor and been supplied to the corresponding deposit devices or the shredder. It can also be provided that the denomination of the individual bank notes is recognized, and information about the denomination of the individual bank notes and the total value of the bank notes supplied to the individual deposit devices and the shredder is additionally determined and stored for later evaluation.

It is likewise possible to sort according to other features of the sheet material or bank notes, e.g. according to denomination, currency, position, orientation, etc. Sheet material or bank notes are then placed in the individual deposit devices and the shredder in accordance with the selected feature.

Sheet material or bank notes that cannot be recognized by checking device 30 because the predetermined criteria are not fulfilled, or whose processing in checking device 30 causes problems, for example because a double pick is present or because sheet material is transported askew in transport device 40, are designated reject cases. Reject cases form the group of sheet material that must be reworked manually. To simplify manual reworking, the group of sheet material forming reject cases is divided into at least two subgroups. The subgroups are placed in different deposit devices. For example, the first subgroup is placed in deposit device 50, 60, the second subgroup in deposit device 51, 61.

The first subgroup placed in deposit device 50, 60 contains sheet material that is unrecognizable and/or was recognized as faulty, whereas the second subgroup placed in deposit device 51, 61 contains sheet material recognized as false. The first subgroup can contain in particular sheet material having other features than the sheet material placed in deposit devices 52 to 64. This may be for example other denominations, if the sheet material consists of bank notes. Further, the first subgroup is assigned sheet material whose mechanical processing in apparatus 1 caused problems, for example double picks, skew of sheet material in the transport system, etc.

The second subgroup placed in deposit device 51, 61 contains sheet material that was recognized as a forgery or suspected forgery in the case of bank notes for example, or sheet material or bank notes in other positions, i.e. sheet material or bank notes having an orientation that deviates from the desired orientation, for example sheet material lying on the front instead of the back.

The second subgroup of sheet material contains, as described by way of example above, sheet material or bank notes that do not fulfill the predetermined criteria checked by checking device 30 (forgeries or suspected forgeries and faulty positions) but have been fundamentally recognized and can thus be added to the processing result of apparatus 1. For this reason, accounting data, such as denomination or number of sheets, are determined for deposit device 51, 61 and combined with the accounting data for further deposit devices 52 to 64 and the shredder to permit a statement about the processing result of the stacks of sheets inserted into singling device 10, 20. Manual reworking is thus no longer immediately required to permit a statement about the stack of sheets to be processed. Reworking can be done at a later time, and be performed for example by experts who have great experience with forgeries.

The first subgroup placed in deposit device 50, 60 must be immediately reworked manually, however, since it contains sheet material that is unrecognizable or whose recognition is faulty, for example because there are mechanical problems, as described above. For further relief of manual reworking, it can be provided that the sheet material of the first subgroup placed in deposit device 50, 60 is inserted into singling device 10, 20 again to repeat processing in apparatus 1. It is to be assumed that certain errors, such as double picks, do not recur in reprocessing, so that the quantity of sheet material to be reworked manually is reduced. Sheet material finally remaining in deposit device 50, 60 is reworked manually and the result of manual reworking can be inputted into apparatus 1 by means of an input device to complete the accounting data, such as number of bank notes, etc.

Further, it can be provided that features of the sheet material allotted to the second subgroup that uniquely identify the individual pieces of sheet material of the second subgroup are detected and stored. Such features can be for example serial numbers, in particular if the sheet material allotted to the second subgroup involves bank notes. Likewise, the data of the sheet material detected by the sensors of checking device 30, or the data formed therefrom by the control device of checking device 30, can be stored in checking device 30 or its control device. The stored unique features can be used for a later time to permit retracing of sheet material. For this purpose the detected features or the data of the sheet material are linked and stored with information, such as name, identification number or account number of the presenter of the sheet material.

Figure 2:
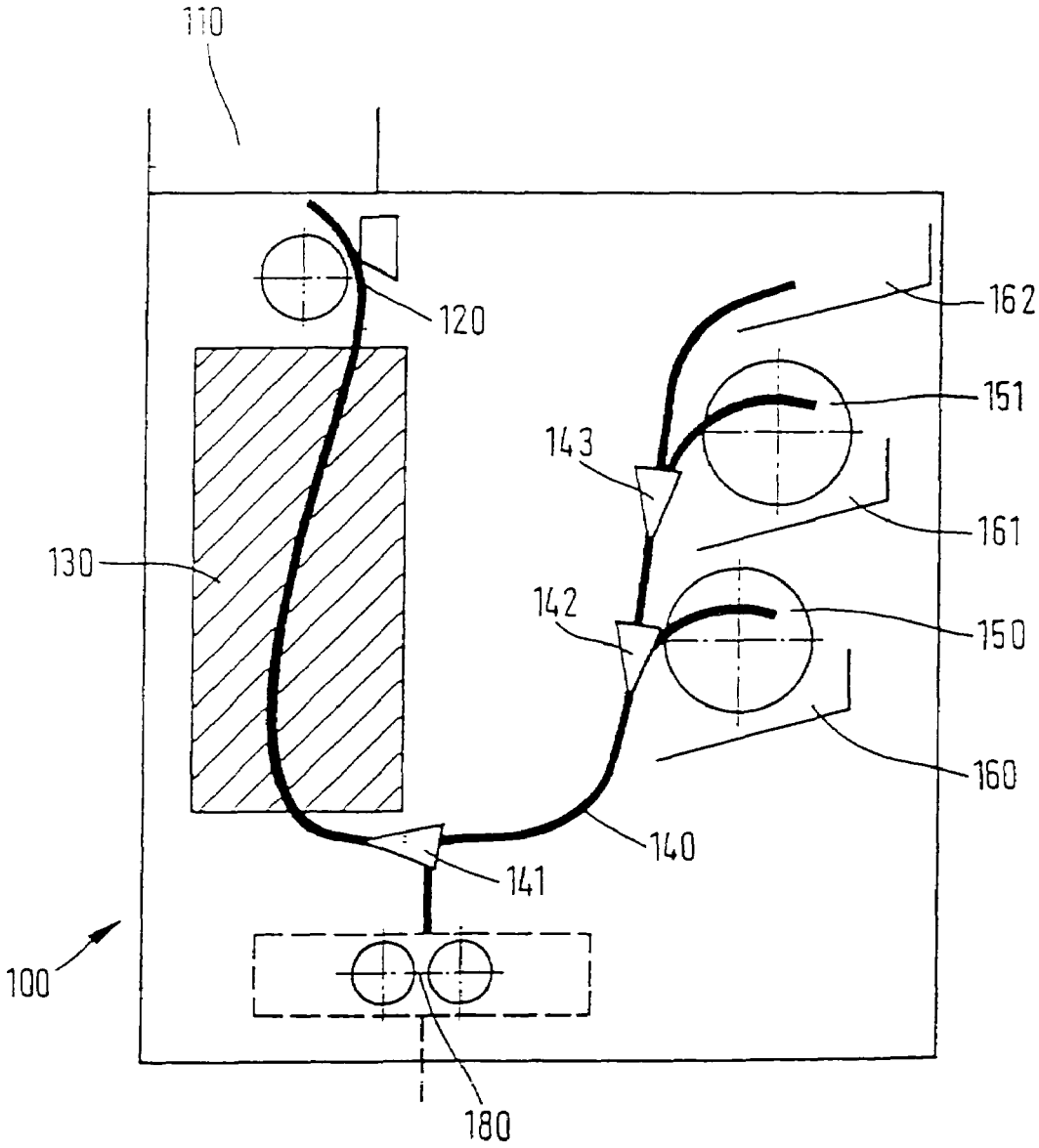
FIG. 2 shows a schematic representation of a second embodiment of an inventive apparatus for processing sheet material.

FIG. 2 shows a schematic representation of a second embodiment of inventive apparatus 100 for processing sheet material.

Apparatus 100 contains input pocket 110 for inputting a stack of sheets, singler 120 for singling the sheet material forming the stack of sheets in such a way that a single piece of sheet material is always inputted into transport system 140. Transport system 140 leads through checking device 130 where sheet material is checked. Checking device 130 is constructed in known fashion and contains for example optical, mechanical, magnetic and acoustic sensors that check the sheet material. If the sheet material to be checked is formed by bank notes, the check performed by the checking device can consist for example in checking the authenticity of the bank notes and their fitness with respect to soiling and wear. The signals of the different sensors are evaluated by the controller in checking device 130 and checked for adherence to predetermined criteria. The predetermined criteria can be for example threshold or limiting values that the sensor signals must be within to yield a valid check.

On the basis of the sheet material check performed by checking device 130, sheet material is supplied to different deposit devices 150, 160, 151, 161, 162. For this purpose, diverters 142, 143 located in transport system 140 are activated by checking device 130 in dependence on the check result. Further, diverter 141 is provided in transport system 140 for supplying sheet material to shredder 180 for destruction.

Checking device 130 contains a controller, which can be formed for example by a microprocessor, that performs both the evaluation of data delivered by the sensors and the control of the individual components of apparatus 100. Deviating from this, it can be provided that there is not only a controller in checking device 130 for evaluating the signals of the sensors but also a further controller for performing the control of the individual components of apparatus 100 in dependence on the results of checking device 130.

Deposit devices 150, 160, 151, 161 can be formed for example by known spiral slot stackers. The spiral slot stackers have rotating units 150, 151 with pockets disposed in a spiral shape into which sheet material is introduced by transport system 140. A stripping device engaging the rotating unit is used to remove sheet material from the individual pockets and place and stack it in deposit devices 160, 161.

The checking and sorting of sheet material in apparatus 100 corresponds substantially to the procedure described above in connection with the first embodiment according to FIG. 1. In particular, the sheet material, or bank notes forming the sheet material, can be checked according to different features such as denomination, soiling, wear, position, etc., and sorted and placed in deposit devices 150, 160, 151, 161, 162. However, if the procedure is as in the above-described example, i.e. authentic bank notes with very good fitness are placed in deposit device 150, 160, authentic bank notes with good fitness in deposit device 151, 161 and authentic bank notes with poor fitness in shredder ISO, only deposit device 162 is available for the group of sheet material, or bank notes, not fulfilling the criteria of the check by checking device 130. Division into subgroups is thus impossible.

It can therefore be provided according to the invention that the stacks of sheets formed in deposit device 162 and containing sheet material of all subgroups is checked and sorted again by apparatus 100. For this purpose the stack formed in deposit device 162 upon a first check is placed in input pocket 110 and resingled by singler 120. The singled sheet material is then again checked by checking device 130 and supplied to deposit devices 150 to 162 or shredder 180 by transport device 140 and diverters 141 to 143 in dependence on the check result. The group of sheet material fulfilling the criteria is thereby placed for example in deposit device 150, 160, sheet material not fulfilling the criteria, i.e. forgeries or suspected forgeries (second subgroup), is placed in deposit device 151, 161, whereas sheet material that is unrecognizable and/or was recognized as faulty (first subgroup) is placed in deposit device 162.

As described above in connection with the first embodiment, accounting data for sheet material fulfilling the criteria and for sheet material of the second subgroup can be determined upon rechecking and added to the accounting data of the first check in order to supplement and/or alter them. Features that uniquely identify sheet material of the second subgroup can likewise be detected and stored.

Besides the formation of two subgroups for the group of sheet material not fulfilling the checked criteria as described above for the first and second embodiments, more than two subgroups can also be formed.

For example, unrecognizable sheet material can form a first subgroup, faulty sheet material a second subgroup, and forgeries or suspected forgeries a third subgroup. A fourth subgroup can be formed by sheet material fundamentally recognized as authentic but having for example the wrong orientation or position. The different subgroups can then be placed in different deposit devices.

Accounting data of the third and fourth subgroups can be determined and made available for further processing. The features of sheet material of the second subgroup can likewise be detected and stored to permit assignment upon later reworking.

The division into subgroups can also be freely configurable. This means that a certain criterion or a plurality of certain criteria are selected, and fulfillment or nonfulfillment of the selected criterion or criteria decides on the assignment of the checked sheet material to the subgroups.

The assignment of the individual groups and subgroups to certain deposit devices or a shredder as described above in connection with the groups and subgroups represents a possible example. Any other assignment is possible anytime and can be effected for example in dependence on the desired sorting by the apparatus.

The invention claimed is:

1. A method for processing sheet material, comprising the following method steps:

singling a stack of sheet material, checking the singled sheet material for adherence to predetermined criteria permitting processing of the sheet material, and forming at least a group of sheet material fulfilling the processing criteria and a group of sheet material not fulfilling the processing criteria and requiring manual reworking for evaluation or checking of the sheet material; and depositing the sheet material as a function of the result of the checking, wherein, the group of sheet material not fulfilling the criteria is divided into at least two subgroups, a first subgroup containing sheet material that is unrecognizable and/or was recognized as faulty, and a second or further subgroup containing sheet material not fulfilling the processing criteria but recognized during the check;

wherein the subgroups are deposited separately.

2. The method according to claim 1, wherein the number of sheets allotted to the second or further subgroups is determined.

3. The method according to claim 2, wherein a total number is determined from the number of sheets in the second or further subgroups together with a number determined for the group of sheet material fulfilling the processing criteria.

4. The method according to claim 1, wherein features of the sheet material allotted to the second subgroup that uniquely identify the individual pieces of sheet material of the second subgroup are detected and stored.

5. The method according to claim 4, wherein the detected and stored features are a serial number or data from the check of a particular piece of sheet material.

6. The method according to claim 1, wherein the sheet material of the first subgroup is resingled and rechecked.

7. The method according to claim 1, wherein the stack of sheet material to be singled is the result of a prior check and is formed from the group of sheet material not fulfilling the processing criteria in that it consists of first and second subgroups.

8. An apparatus for processing sheet material, comprising a singling device for singling a stack of sheet material, a transport system for transporting the singled sheet material, a checking device disposed along the transport system for checking the singled sheet material for adherence to predetermined criteria permitting processing of sheet material, the checking device dividing sheet material into at least a group of sheet material fulfilling the processing criteria and a group of sheet material not fulfilling the processing criteria and requiring manual reworking for evaluation or checking of the sheet material; and at least two deposit devices for depositing the groups of sheet material, wherein the checking device is arranged to divide the group of sheet material not fulfilling the processing criteria into at least two different subgroups, two different deposit devices are arranged to receive the at least two different subgroups, and said first deposit device is arranged to receive sheet material that is unrecognizable and/or was recognized as faulty, and said second deposit device is arranged to receive sheet material not fulfilling the processing criteria but recognized during the check by the checking device.

9. Apparatus according to claim 8, wherein the number of sheets placed in the second deposit device is determined.

10. Apparatus according to claim 9, including a device for determining the number of sheets placed in further deposit devices, and for determining a total number from said number together with the number of sheets in the second deposit device.

11. Apparatus according to claim 8, including a detector for detecting features of the sheet material placed in the first deposit device that uniquely identify the individual pieces of sheet material placed in the first deposit device and the checking device is arranged to store said features.

12. Apparatus according to claim 11, wherein the detected and stored features are a serial number or data of the particular piece of sheet material that are obtained during checking by the checking device.

* * * * *